US007689347B2

(12) United States Patent
Wall, III

(10) Patent No.: US 7,689,347 B2
(45) Date of Patent: Mar. 30, 2010

(54) TRAFFIC SIGNAL LIGHT CONTROL SYSTEM AND METHOD

(76) Inventor: Henry H. Wall, III, 6025 Jessamine, Houston, TX (US) 77081-6401

( * ) Notice: Subject to any disclaimer, the term of this patent is extended or adjusted under 35 U.S.C. 154(b) by 1071 days.

(21) Appl. No.: 11/360,958

(22) Filed: Feb. 24, 2006

(65) Prior Publication Data

US 2008/0086258 A1 Apr. 10, 2008

Related U.S. Application Data

(60) Provisional application No. 60/659,112, filed on Mar. 8, 2005, provisional application No. 60/659,184, filed on Mar. 8, 2005.

(51) Int. Cl.
*G06G 7/76* (2006.01)

(52) U.S. Cl. ..... 701/117; 340/905; 340/907; 340/909

(58) Field of Classification Search ..... 701/117; 340/933

See application file for complete search history.

(56) References Cited

U.S. PATENT DOCUMENTS

| | | | | |
|---|---|---|---|---|
| 4,370,718 | A | 1/1983 | Chasek | |
| 4,908,615 | A | 3/1990 | Bayraktaroglu | |
| 5,444,442 | A | 8/1995 | Sadakata et al. | |
| 6,317,058 | B1 | 11/2001 | Lemelson et al. | |
| 6,366,219 | B1 | 4/2002 | Hoummady | |
| 6,567,748 | B2 * | 5/2003 | Matsuno | 701/301 |
| 6,633,238 | B2 | 10/2003 | Lemelson et al. | |
| 2003/0189499 | A1 * | 10/2003 | Stricklin et al. | 340/933 |
| 2004/0145497 | A1 * | 7/2004 | Pearson | 340/906 |
| 2004/0218784 | A1 | 11/2004 | Nichani et al. | |
| 2005/0053274 | A1 * | 3/2005 | Mayer et al. | 382/154 |
| 2006/0095199 | A1 * | 5/2006 | Lagassey | 701/117 |
| 2006/0200307 | A1 * | 9/2006 | Riess | 701/207 |
| 2006/0200312 | A1 * | 9/2006 | Osaka | 701/211 |
| 2007/0171293 | A1 * | 7/2007 | Okamoto | 348/333.01 |

OTHER PUBLICATIONS

Jun Wei Han and Lei Guo; A Shape-based Image Retrieval Method; Journal Abstract, Signal Processing: Image Communicatio, Feb. 2003, pp. 141-156, vol. 18, Issue 2.

Tsechpenakis, G. et al; A Snake Model for Object Tracking in Natural Sequences; Journal Abstract; Signal Processing: Image Communication; Mar. 2004; pp. 214-230, vol. 19, Issue 3.

* cited by examiner

*Primary Examiner*—Khoi Tran
*Assistant Examiner*—Rodney King
(74) *Attorney, Agent, or Firm*—Buskop Law Group, PC; Wendy Buskop

(57) ABSTRACT

An apparatus or system and method to control traffic at an intersection which uses a digital camera with pan, tilt, zoom, fast position and autofocus to send information to an integrated central processing unit having image processing algorithms which evaluate and analyze less than the entire image to determine whether a vehicle(s) is (are) present or are approaching and its (their) size, speed and distance in order to solve logical propositions to maintain or change the right of way by signal to a conventional traffic control signal unit.

13 Claims, 1 Drawing Sheet

TRAFFIC SIGNAL LIGHT CONTROL SYSTEM AND METHOD

CROSS REFERENCE TO RELATED APPLICATIONS

This application is related to Provisional Applications Nos. 60/659,112 and 60/659,184, dated Mar. 8, 2005, by Applicant.

FIELD OF THE INVENTION

BACKGROUND OF THE INVENTION

This invention relates to an apparatus or system and method or process for controlling the movement of one or more objects as they approach a point at which the objects are likely to collide if a control apparatus or system is absent. More specifically, a practical application of the present invention is the apparatus or system and method or The recent shortage of gasoline after hurricanes Katrina and Rita indicate that conservation of energy is necessary since the slightest disruption in supply causes an inordinate amount of increase in the price of energy, particularly oil, gasoline and natural gas. One major source of wasted gasoline and frustration for motorists is the inefficient traffic control system used in cities and towns. This is very evident when one waits at traffic lights with no opposing traffic coming and long unnecessary stops at street intersections adds to air pollution problems as well. These facts have been noted in numerous traffic professionals' publications and the details are not necessary to quote in respect of the background for the present invention.

Several prior art patents provide improved apparatus or systems and methods or processes which are improvements over the traditional tri-color traffic signal on a fixed timed protocol for regulating and controlling vehicular and pedestrian traffic at any particular intersection. For example, U.S. Pat. No. 6,366,219 to Moummady includes an elaborate traffic management system using a video camera that provides data on the intersection, is converted to digital imaging information, and is processed and analyzed. The analysis is used to simulate and validate a strategy for traffic control prior to on-site implementation. However, such a system is overly complex and simplification would be beneficial. U.S. Pat. Nos. 6,633,238 and 6,317,058 to Lemelson et al. rely on fuzzy logic and global positioning system (GPS) via satellite technology to track moving vehicles and provide warning signs on or near traffic signals, or even in vehicles properly equipped, for communicating with the GPS system and for optimizing traffic light phase split based on the traffic information from the traffic information units. However, this requires very complex coordination between GPS and traffic information units and would be very difficult to implement widely. U.S. Pat. No. 5,444,442 to Sadakata et al. provide a method for predicting traffic space mean speed and traffic flow rate and apparatus for controlling traffic using the predicted traffic flow rate. The system uses a measurement of traffic density on the road to predict a traffic flow rate and includes video cameras for picking up images of a traffic condition at an upper stream of an intersection, an analog/digital converter for converting the image data into a digital video signal, two sets of image memories for storing the digital image data for two scenes captured, a data process/control unit for calculating a total number of vehicles with a predetermined area and calculating a correction coefficient and an input/output unit for interfacing with the traffic control signal. However, this system and method uses complex video image processing and analog video systems which need conversion to digital signals and, further, uses traffic estimates and correction coefficients to control the traffic light. U.S. Pat. No. 4,908,615 employs a radar traffic light control system with a transmitter/receiver module including an array of interconnected microstrip patch antennas which also act as the resonators for oscillators powered by IMPATT diodes; varactors on the interconnections permit beam steering for scanning roadways. However, this system requires an interconnected array of antennas and receivers to gain the whole picture of the intersection or roadway. Other mechanical systems such as road embedded loop antennas or pneumatic strips across the roadway give limited information and require expensive maintenance and traffic interruption. Thus, an improved system or apparatus and method or process for traffic regulation and control to provide a smooth flow of traffic is desirable and is provided by the present invention.

It is, therefore, an object of this invention to provide a method or process for controlling traffic at intersections without overly complicating a digital camera input device with the total image which the camera can observe and capture as images. It is another object of this invention to use a digital camera to avoid the step of converting the image captured into digital format for processing. It is a still further object of the present invention to provide an apparatus or system combining a digital camera with a roadside marker and a central processing unit having a computer program which obtains the digital image, processes and analyzes less than the entire image for information on the traffic and then proceeds through a logical progression to produce an output which changes the traffic signal light in a safe and efficient manner so that energy and emotion is conserved. These and other objects will be readily apparent from the following description of the invention

SUMMARY OF THE INVENTION

The present invention provides a method or process for controlling the movement of a first object in a first lane so that it does not collide with a second object moving in a second lane which intersects with the first lane by providing a digital image of the convergence of the first and second objects, processing and analyzing less than the entire image so provided using a logical algorithm to determine whether the first or second object should have the right of way and sending a control signal to a control unit at the intersection. Also provided by the present invention is at least one viewing means for capturing an image of the intersection, a means for analyzing and evaluating less than the entire image captured and according to a logical algorithm producing a control signal, and a control unit for receiving the control unit so that the control unit provides a right of way signal to one of the objects in preference to the other.

BRIEF DESCRIPTION OF THE DRAWINGS

The FIGURE of the drawing, identified as FIG. 1, is a logic diagram of the process for traffic control of the invention.

DETAILED DESCRIPTION OF THE INVENTION

Figure 1:
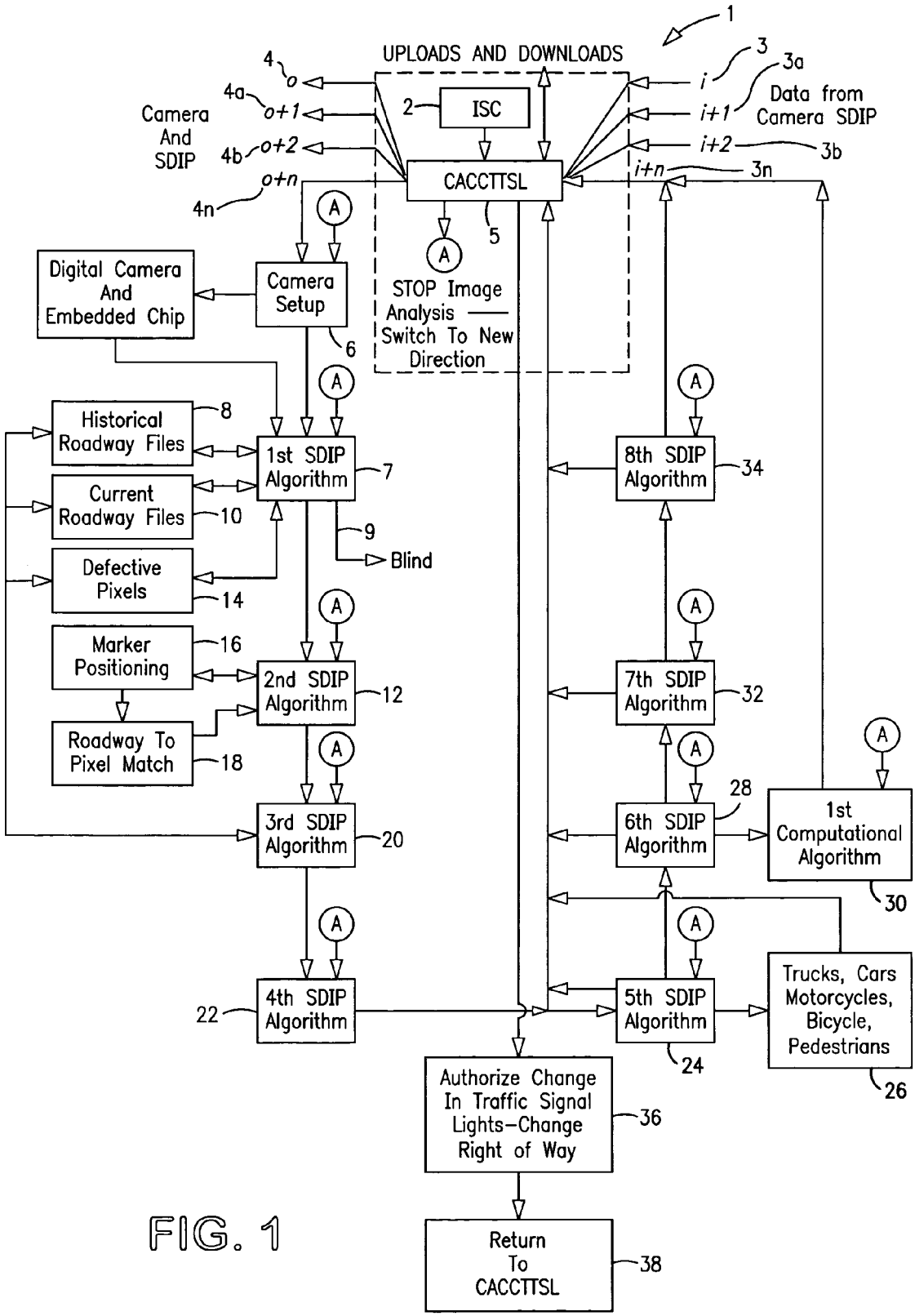

The present invention is a system or apparatus for preventing the collision of or for regulating the movement through an intersection where at least a first moving object must cross an intersection with another lane having a second moving body therein and which is moving toward the intersection. Also, a process or method for the regulation of moving bodies on a collision course through an intersection is contemplated by the present invention. This invention has use in the industries related to automatic warehousing logistics, biomedical and biomechanical areas, micromanufacturing, space physics, traffic control and the like. Although aspects of the present invention are operable in 3 dimensions, for the purposes of explanation and description, there is described the use of the instant invention in a 2-dimensional plane, such as, for purposes of illustration only and without limitation, the intersection of at least two roadways which are regulated and controlled by a tri-color traffic light. In this embodiment, the present invention provides a traffic control apparatus adjacent an area of interest in which one or more moving objects is to be controlled for efficiency and safety in passage through said area, said apparatus including a) at least one means for viewing said area of interest and capturing at least one image thereof to provide information related to movement of one or more of said objects through said area of interest, b) means for analyzing and evaluating said information, using less than the entire image to provide location, speed, direction of travel, size and distance from said area of interest parameters for one or more of said objects in order to provide said parameters as data for algorithms to solve a logical proposition for regulation of the passage through said area of interest and provide an appropriate control signal, and c) at least one control signal means for regulating the passage of one or more of said objects through the area of interest.

The present invention in a preferred embodiment of the apparatus of this invention includes the area of interest being an intersection of one or more streets or roadways and in which the means for viewing the area of interest is a high resolution digital camera. A more specific embodiment features the high resolution digital camera having the ability to pan 360 degrees horizontally and 180 degrees vertically and zoom from 1 to 10 times with automatic focus. Also featured as a part of the present invention is a marker means of sufficient size and shape that it can be distinguished and identified using the camera. Particularly suitable for the marker means is a flat, geometrically shaped marker having a highly reflective surface, which is sized to be readily recognized by the viewing means or camera and is capable of night time viewing. For example, the marker may have fluorescent paint, which glows in the dark, or have an electrical glow wire, which is visible by infrared sensor in the camera.

Another component of the present invention is a means for analyzing and evaluating data observed and captured in the form of at least one image which is an integrated central processing unit. A more preferred embodiment of the present invention is an integrated central processing unit which has a simplified digital image processing algorithm to process less than the entire image or series of images captured by the viewing means and compare such image or series of images to a previously captured image of the area of interest which is unoccupied and determine the location, speed, direction of travel, size and distance from the area of interest of any object in the area of interest, the comparison providing data to solve logical algorithms using such data for regulation of the passage of one or more objects through the area of interest by generating an appropriate control signal to the control signal means to regulate the passage of one or more of the objects through the area of interest. A still further embodiment of the integrated central processing unit is a digital computer means for analyzing one or more of the images or series of images captured by the digital camera, which digital computer means employs a simplified digital image processing algorithm to process less than the entire image captured in the image or series of images in order to provide data to a logical algorithm for regulation of passage of one or more of the objects through the area of interest. A still further embodiment of the present invention is the control signal means being a tricolor traffic control signal.

The present invention further comprises a process or method for regulating the movement of one or more discrete bodies in motion in specific intersecting lanes and intersecting motion so that collision of such bodies in the intersection is avoided and the bodies proceed through the intersection in a safe and efficient manner, the process comprising the steps of a) capturing at least a portion of an image or series of images of the discrete bodies approaching the intersectional area over a discrete period of time, using a camera means and including a known marker means at a predetermined location in at least a portion of the image or series of images;

b) comparing the captured images to a known image of an unoccupied lane in order to determine the size, speed of approach to, distance from the intersection and direction of travel of at least one such discrete body, if any;

c) based on the calculated size, speed, distance from the intersection and direction of travel, determining the most efficient and effective protocol for allowing at least one of such discrete bodies to enter and safely pass through the intersection, and d) signaling a control means to operate at such a safe and efficient method for allowing one or more of the discrete bodies to pass through said intersection. A further feature of the method or process of this invention includes the step (b) being carried out using one or more algorithms for comparing at least a portion of the image or series of images using triangulation calculations to determine the size, speed, distance and direction of travel of any discrete bodies captured in the image or series of images. A still further feature of the present invention is a process or method as previously described in which a failsafe intersectional area protocol is used in the event that a useable image or series of images cannot be captured or the system or apparatus suffers some dysfunction. A further feature of the process or method of this invention is the additional step of (e) intervening in the process at any step by an operator to manually control the intersectional control signal means or traffic light.

The viewing means is preferably a camera, radar transmitter/receiver or other optical device that provides a captured image to the integrated central processing unit for analysis and evaluation according to this invention. Preferred for use in the instant invention is a camera, and more preferred is a high resolution digital camera. Several such cameras are available which are suitable for the apparatus of the present invention. Known are the Cohu, Inc., Electronics Division 470 HTVL resolution color camera, which can be conveniently incorporated into the Cohu Model 3920 system having i-dome enclosure, the high resolution CCTV camera, fast positioner, and sealed and pressurized dome enclosure. Also available is Sony Corporations SSC-M383CE high resolution, black and white video camera. Other high resolution, digital video cameras are available with CCD chips, CMOS chips, embedded chips and devices, surveillance camera systems, camcorders, and optical systems available. It is not intended to limit the present invention to any particular viewing means and several are suitable for the present invention as indicated herein; however, for the purposes of simplification in explanation, the embodiment of a high resolution digital camera will be used for further description of the apparatus and process of the present invention.

The means for analyzing and evaluating information which is provided by the camera is preferably an integrated central processing unit which has a program for denominated Computational Algorithm for Calculating Changes in Timing of Traffic Signal Lights, hereinafter CACCTTSL for short. The CACCTTSL controls digital image processing to determine the presence, location, speed, direction of travel, size and distance from the area of interest, or for example an intersection. This data is used by the algorithms in addition to CACCTTSL to solve a logical proposition for regulation of the passage of traffic, usually vehicles, through the area of interest. For purposes of subsequent, but non-limiting description, the area of interest is an intersection of at least two streets or roadways. CACCTTSL has supervisory control over the digital image processing, but does not contain the algorithms per se. When the CACCTTSL has determined that a change in the right of way or green light of a traffic control signal unit is necessary, the appropriate signal is provided to the traffic control signal unit and the right of way is changed. Further description of the CACCTTSL program and its supervisory control of the digital image processing algorithms is provided hereinbelow.

The present invention also requires a traffic control signal unit that for the purposes of this invention is conventional. The traditional tricolor traffic light is the best known and most common such traffic control signal unit. However, also included in this invention is the use of directional signals such as turn signals, the use of multiple signals for various lanes. However, any conventional traffic control signal unit can be used and is not novel per se, but only in combination with the traffic control apparatus of the present invention.

In a preferred embodiment of the apparatus of this invention, a marker means is employed to act as a camera direction pointing reference for the CACCTTSL program. Any conventional traffic control sign type of marker means can be used if it is of sufficient size, say from about 3 to about 24 inches on a side, has a highly reflective surface and a fixed and precise geometry for recognition by the CACCTTSL program or its algorithms. The marker means can be installed on dedicated pole, on a signal pole, on a utility pole or if conveniently located on a building near the adjacent street or roadway. The marker should be located from about 500 to about 1000 feet from the camera, but limitations on distance from the camera depend entirely on the ability of the camera to focus and provide sufficiently accurate images to the simplified digital imaging processing algorithms. The location of the camera and marker are initially input by the installer. Also, the size, design and distance are installer input data, allowing an SDIP algorithm to search in the area of the marker, to locate the marker and to determine the direction of the camera on the known location of the marker. At the optical magnifying power necessary to be able to calculate locations and speeds for vehicles as far away from the camera as 2000 feet, each pixel may represent a point from about 0.5 inches to about 3 inches from the next closest point. For the extreme case of a 3 inch spacing, a marker should be more than about 12 by about 96 inches.

The prior art patents have previously attempted to use image processing in traffic control, as described above. However, applying the panoply of character recognition programs, surveillance camera technology, and security software that attempts to recognize individuals or 3D systems, requires too much computational effort and dramatically slows the image processing. It therefore was recognized that a system which employed image processing of less than all of the captured image was sufficient to calculate location, distance, speed and approximate size of objects approaching an intersection, specifically vehicles of various shapes, or even motorcycles and bicycles. Because vehicles on a roadway travel in generally straight lines at known elevation and fairly predictable speeds and have considerable size, pixels which would render an approximation of the entire image can be selected for processing at considerably increased speed and with sufficient accuracy to accomplish the objectives of traffic recognition and subsequent control in real time. This process, as used in the present invention, has been named Simplified Digital Image Processing (SDIP) and is used in the apparatus and process of the present invention to great advantage.

The process of a preferred embodiment of the present invention is more specifically described in the figure of the drawing, FIG. 1 which is a Logic Diagram for the Traffic Control Signal Computer Program. In addition to normal operating system software, including input/output, communication and calculation features, the central processing unit employed in the present invention includes a program, identified previously, as CACCTTSL, that is comprised of several sub-programs or algorithms for specific functions as described hereinafter and several SDIP Algorithms for less than entire image processing. As shown in FIG. 1, the CACCTTSL logic diagram provides a central processing unit or cpu 1 which allows an input signal from an outside source, such as an installer supervisory control (ISC) computer 2, for example, from an initial installers computer, a centralized traffic control computer, or from a network of intersections overall control computer. Also, inputs i, i+1, i+2, . . . , i+n, which are 3, 3*a*, 3*b*, . . . , 3*n*, respectively, from the SDIP algorithms into the CACCTTSL program 5; while outputs o, o+1, o+2, . . . , o+n, which are 4, 4*a*, 4*b*, . . . , 4*n*, respectively, are sent with instructions for change in position to the viewing means or request for data to various SDIP algorithms. The data or information received by the cpu 1 from the viewing means is input to the main evaluation and analysis program of SDIP algorithms. The CACCTTSL program 5 initiates the analysis and evaluation by giving instructions to camera set up module 6, which controls camera position and provides for pan, tilt or zoom movement to allow better viewing of a particular zone or area of interest in or around the intersection. Then First SDIP Algorithm 7 establishes from the data provided by the viewing means or camera whether some atmospheric condition has blinded the observation by comparison with a "historical" library of roadway files 8 maintained in memory. The historical roadway files 8 maintain in memory data representing empty road pixel values for each point of each lane of each roadway filed according to time of day, day of year, year and weather conditions, such as dry, wet, flooded, iced, snow-covered or the like. These files are permanent. Where no vehicle is detected, a second file is set up for the same time, day, year and weather condition as a variant of the historical roadway files 8, and this variant of the historical is stored in current roadway files 10. If the current roadway file 10 data is identical, within limits, to the same roadway condition stored in historical roadway files 8, the current roadway file 10 is not kept longer than required. In the event that a sample of the pixels in the data show a "sameness", that is the pixels are essentially the same, then a wider sampling of pixels is triggered and in the further event that this "sameness" of the pixels is confirmed, then the conclusion is reached that the viewing means is blind and a blind output signal 9 is sent to the traffic control signal means to revert to a standard protocol for granting right of way or the green light to a roadway in the intersection and the CACCTTSL program logic reverts to another iteration of pixel sampling until a non-blind condition is detected.

When the First SDIP Algorithm 7 encounters a sampling of pixels which are different, or in other words, the pixels do not represent a "sameness" of light condition, then a comparison of current roadway files 10 is conducted and differences are sent to the Second SDIP Algorithm 12. The library of defective pixels 14 is consulted via a subroutine to determine whether a particular pixel has become non-responsive to light in order to maintain a list of defective pixels so that these can be excluded during simplified image processing. The Second SDIP Algorithm 12 is to establish or calibrate accurately the position of the viewing means or camera. It determines the camera position in order to avoid errors from movement caused by wind or vibration as a result of traffic or nearby activity. Even though the camera is not moved between image or partial image capture, for instance, between images captured which are spaced 1 second apart, movement of the camera must be taken into account during image processing. Further, when the camera is repositioned to a different roadway, calibration is again necessary. Calibration is necessary during image capture and for each image captured. As indicated previously, camera position is established by reference to a distinct marker means installed at a known location in or around the intersection, as initially input during installation setup, initializing or maintenance. The size, distance, location and design allow Second SDIP Algorithm 12 to search for a marker and identify it using marker positioning subroutine 16. When the Second SDIP Algorithm 12 detects a match with a particular marker from the marker positioning subroutine 16, then the camera direction is known and the roadway is identified. These pixels in the known roadway are then stored in roadway to pixel match file 18. This matching or identification data is provided to allow the Third SDIP Algorithm 20 to select the appropriate clear or empty roadway condition from historical roadway files 8 or current roadway files 10. This matching or identification data is compared to the selected pixel data from the Fourth SDIP Algorithm 22, which has the objective of finding a vehicle on the roadway. As the installed data have established the position of each lane from the intersection to as much as 2000 feet from the intersection, Fourth SDIP Algorithm 22 searches the pixels along the lanes in the same direction from the intersection, selecting pixels which are spaced apart sufficiently to nevertheless detect motorcycles, small cars and the like. The sampled pixels which are less than the total number of pixels forming the captured images, as explained hereinabove, are compared to the temporary file of the roadway in current empty roadway files 10. If there is not a match, the permanent files in the historical roadway files 8 are searched. Again if there is not a match, the atypical pixels are selected as focal points for the search for vehicles or other objects in the lanes of interest. In addition the CACCTTSL program 5 is notified of these focal point pixels as part of the early notice and continual update feature of the procedure used by the overall system. The atypical pixel locations are provided to the Fifth SDIP Algorithm 24 to start a search for one or more vehicles. On a pixel by pixel search, the form of a vehicle is filled in and compared to files of motor vehicles, such as trucks, cars, motorcycles, bicycles and pedestrians maintained in vehicle files 26. The size and shape is compared to the memory files for a match or close approximation. It should be noted that to match the size or shape of, for example, a vehicle, the image processing must take into account the height of the camera, the angle at which viewing occurs and the distance away from the camera because these and other factors may influence the target vehicle's aspect and thus alter the shape with which a match could be made. In other words some compensation may need to be made for the comparison to the memory file. If the target vehicle (pixels) is too long, it is considered by the Fifth SDIP Algorithm to be a line of vehicles travelling at the same speed. The CACCTTSL program 5 is notified about the results as part of the early notification and continual update feature of the overall system procedure.

The information or data is also provided to the Sixth SDIP Algorithm 28 which calculates the distance of the vehicle(s) from the intersection using simple triangulation calculations speed on the height of the camera above the roadway, the direction in which the camera is pointing, the elevation of the lanes as a function of distance from the intersection and using the lowest point of the vehicle(s) as one corner of the triangle. It is almost immaterial what point on the vehicle(s) is used for the calculation, e.g., the front bumper, front tire, the shadow on the ground, or the headlight at night, since the variation of the reference point on the vehicle introduces only very small error into the calculations. The CACCTTSL program 5 is notified of the distance as part of the early notification and continual update feature of the overall system procedure. First computational algorithm 30 uses consecutive results from the Sixth SDIP Algorithm 28 at a spacing of about 1 second for the calculation of the speed of the vehicle(s) and of the estimated time at which the intersection will be reached. The CACCTTSL program 5 is notified of the results. The Seventh SDIP Algorithm 32 gathers images of all lanes, including turn lanes, at the intersection according to instructions from the CACCTTSL program 5 and instructs how far to search along each lane. Information from the Fifth SDIP Algorithm 24 is used to determine the images based on atypical pixels provided by the Seventh SDIP Algorithm 32. After the vehicle(s) have been located, identified and the speed has been determined, the Eighth SDIP Algorithm 34 is used to calculate the expected new location of the vehicle(s) and looks for it(them) in data supplied from the camera (not shown). Once verified, an output of the new distance, speed, and expected time of arrival at the intersection is notified to the CACCTTSL program 5. With this new data, the CACCTTSL program 5 then runs its logical protocol to determine whether to maintain the right of way currently shown on the traffic control signal light or when to stage the light for granting the right of way to another lane or to a turn lane. The CACCTTSL program 5 also determines when to stop analyzing a specific direction or lane of traffic on a roadway or what data are required. The CACCTTSL program 5 does this through inputs to the various algorithms and camera via the stop/change input labeled A in FIG. 1. The CCACCTTSL program 5 then instructs the imaging and evaluation and analysis system to begin in a different direction or of the intersection itself As indicated, the overall logic of the traffic control program is handled by the CACCTTSL program 5 based on SDIP evaluation and analysis. The logical proposition is hierarchical in nature and considers five cases in specific order. They are as follows:

CASE 1: Right of Way Lanes are Empty. In this case SDIP algorithms have determined that the lanes of the roadway having the green light or right of way are empty. Thus, the right of way should be changed to those lanes having vehicles waiting or approaching within about 20 to 30 seconds.

CASE 2: Right of Way Lanes Have Traffic Which is Not Moving. In this case, the SDIP algorithms have determined that lanes with the right of way have vehicles in them, but the traffic is not moving. The program checks to determine that vehicle(s) in the right of way lane have cleared the intersection before considering whether to return the right of way. Also, the program determines whether the stopped vehicle(s) is (are) being by-passed; thus, allowing continuation of the right of way. Otherwise, the right of way is changed to another lane of the roadway.

CASE 3: Right of Way Lanes are Full and Moving. In this case, the right of way is maintained until priority of traffic guidelines is exceeded. Before the right of way is changed, a calculation is done to determine the cost of kinetic energy, as skilled persons in the art would know how to accomplish, and compare to the guidelines for priority.

CASE 4: Right of Way Lanes Have Traffic but Have a Gap. In this case, the program notes that a space between approaching vehicles, a "gap", is approaching the intersection. A calculation of the kinetic energy to be lost if the gap is not used to change the right of way is compared to guidelines to determine if the cost is too great. If so, a change in right of way is indicated. Otherwise, the change is delayed until priority times are exceeded.

CASE 5: Right of Way Lanes Have Traffic with an End. In this case, the SDIP algorithms have detected that a line of traffic with the right of way has an end. Before the end arrives at the intersection, if priority time is exceeded, the CACCTTSL program 5 will change the right of way. If on the other hand the end arrives at the intersection and the priority time is not exceeded, the program will not change the right of way until after the end of the traffic line has passed the intersection.

Based on the data provided by the camera, the evaluation and analysis of the SDIP algorithms and the logical resolution of the hierarchical cases of the CACCTTSL program 5, a determination to change the right of way is reached and a signal is sent to the authorize change in traffic signal module 36 and the appropriate instruction is sent to the traffic control signal unit (not shown) which is conventional. The authorize change in traffic signal module 36 notifies the return to CACCTTSL module 38 and a signal is given to the CACCTTSL program 5 that the change in right of way has been completed. The CACCTTSL program 5 then stops image processing in the SDIP algorithms and instructs the camera to reposition and the process begins again.

Although the integrated central processing unit 1 containing the CACCTTSL program 5 handles supervisory control and active image processing and initiation of changes in the timing of traffic control signal lights, an operator using the installer supervisory control computer 2 can override the CACCTTSL program 5, using either direct plug-in hardwire connection at the intersection, hardwire or wireless connection to a central traffic dispatch center or wireless or hard wire plug-in connection from a laptop computer. Such intervention allows modification of traffic flow or control guidelines, i.e., the normal or default traffic signal timing protocol, download information to the various memory files, upload traffic information or operating data for archival purposes, reset the system after blind condition or repair and maintenance or troubleshooting the system. The installer supervisory control computer 2 also allows the ability to control the camera and to input, such as by point and click means, information which may be required by the SDIP algorithms. For example, the locations and design of each marker means along the roadways, identification of each lane in the roadway from the intersection and for some distance out, say for example up to or beyond 2000 feet, each turn lane, parking space locations, major obstructions, such as buildings, trees, utility poles, sign posts, wires and the like which exist in the field of the camera's vision.

In another highly preferred embodiment of this invention is the use in step b) of separate computational devices for each algorithm or subroutine so that simultaneous parallel processing of all simplified digital image processing and computations is carried out allowing traffic control in real time.

It should be clear that the foregoing is merely an example of the best embodiment of which Applicant is aware with respect to the invention. One skilled in the art, having the benefit of the present invention description may envision the use of multiple viewing means of the same or different types which might take into account different weather or time factors, such as daylight or dark. Il a similar manner when topography requires, multiple cameras can be employed to negate the effect of hills, curves, dips or other roadway obstructions. Likewise, any suitable or conventional camera technology may be employed, such as the use of black and white, color, or grayscale video technology, and preferably all three. Similarly, the electronic components in such cameras may vary widely so long as sufficient pixel information is obtained to permit simplified digital image processing, that is, using less than the entire image, to make location and identification of vehicles readily apparent in real time.

The present invention can be initially installed at an intersection on a new roadway or can be retrofitted to an existing intersection with relative ease and without disrupting the existing roadway bed or traffic flow. The present invention can be used continually or in intermittent fashion when the CACCTTSL program determines that waiting and slowing and stopping can be reduced or avoided when unnecessary.

In another embodiment of this invention, two or more intersections can be linked together to provide smooth and efficient traffic flow. Likewise, the algorithms can be modified to be controlled from a central traffic dispatch center or station using the results uploaded from several intersections to control traffic.

While the general description of the logical propositions used by the algorithms employed in the apparatus and process of the present invention are practical and workable, the skilled practitioner can readily envision other more detailed or different methods may be employed to reach the same result. Therefore, the present invention should only be limited by the lawful scope of the following claims.

What is claimed is:

1. A traffic control apparatus adjacent at least two roadways in which one or more moving objects is to be controlled for efficiency and safety in a passage through an intersection of the at least two roadways in real-time, said apparatus including a) at least one means for viewing said intersection, at least two roadways, or combinations thereof; and for capturing a series of images thereof to provide information related to movement of one or more of said objects through said intersection, at least two roadways, or combinations thereof;

b) a marker means at a predetermined location, for determining the location of the field of view of the means for viewing;

c) at least one digital computer means with at least one central processing unit comprising computer instructions with algorithms to process less than the entire image of each image of the series of images and to compare less than the entire image of each image of the series of images to a previously captured image of the intersection, at least two roadways, or combinations thereof; wherein the intersection, at least two roadways, or combinations thereof is unoccupied in the previously captured image, for analyzing and evaluating said information to provide location, speed, direction of travel, size and distance from said intersection parameters for one or more of said objects in order to provide said parameters as data for computer program instructions for determining the most efficient and effective protocol for allowing each moving object to enter and safely pass through the intersection for regulation of the passage through said intersection and provide an appropriate control signal, wherein the algorithms are selected from the group consisting of: a first algorithm for determining atmospheric conditions for determining blindness of the means for viewing; a second algorithm for determining the position of the means for viewing; a third algorithm for selecting the previously captured image for comparison with less than the entire image of each image of the series of images; a fourth algorithm for selecting atypical pixels for comparison to the previously captured image and for detecting moving objects; a fifth algorithm for identifying the atypical pixels by comparing the atypical pixels to memory files on the moving objects stored on the at least one digital computer means; a sixth algorithm for calculating the distance of the moving objects from the intersection; a computational algorithm for calculating the speed of the moving objects and for calculating the estimated time of arrival of the moving objects to the intersection; a seventh algorithm for determining a distance along each roadway for the means for viewing to capture images; an eighth algorithm for calculating an expected new location of the moving objects; or combinations thereof;

d) a plurality of inputs in communication with the each central processing unit for receiving data from the algorithms and a plurality of outputs in communication with each central processing unit for sending instructions to the means for viewing; and e) computer instructions for communicating the appropriate control signal to at least one control signal means for regulating the passage of one or more of said objects through the intersection.

2. The apparatus of claim 1, wherein said means for viewing is a high resolution digital camera.

3. The apparatus of claim 2 wherein the high resolution digital camera is a video camera.

4. The apparatus of claim 2 wherein the high resolution digital camera can pan 360 degrees horizontally, 180 degrees vertically and zoom from 1 to about 10 times with automatic focus.

5. The apparatus of claim 1 wherein said marker means is a flat, geometrically shaped marker of a fixed and precise geometry for recognition by the computer instructions with algorithms, has a highly reflective surface, and is sized to be readily recognized by the means for viewing and capable of being viewed at night.

6. The apparatus of claim 2 wherein said at least one digital computer means employs a simplified digital image processing algorithm to process less than the entire image of each of the images captured in said series of images in order to provide data to a logical algorithm for regulation of passage of one or more of said objects through said intersection.

7. The apparatus of claim 1 wherein said at least one control signal means is a tri-color traffic control signal.

8. A process for regulating the movement of one or more discrete bodies in motion in specific intersecting lanes and intersecting motion in real-time so that collision of such bodies in the intersection is avoided and the bodies proceed through the intersection in a safe and efficient manner, said process comprising the steps of a) capturing at least a portion of each image of a series of images of the discrete bodies approaching the intersectional area over a discrete period of time, using a camera means and including a known marker means at a predetermined location in at least a portion of each said image of the series of images for determining the location of the field of view of the camera means; wherein the camera means is in communication with at least one central processing unit of at least one digital computer means, to provide information related to the movement of one or more of said discrete bodies;

b) using computer instructions on each central processing unit, wherein the computer instructions comprise a plurality of algorithms to compare each captured image of the series of images using less than the entire image to a known image of an unoccupied lane in order to determine the size, on speed of approach to, distance from the intersection and direction of travel of at least one such discrete body in the captured image, if any; wherein the plurality of algorithms are selected from the group consisting of: a first algorithm for determining atmospheric conditions for determining blindness of the camera means; a second algorithm for determining the position of the camera means; a third algorithm for selecting the known image for comparison with less than the entire image of each captured image; a fourth algorithm for selecting atypical pixels for comparison to the known image and for detecting discrete bodies; a fifth algorithm for identifying atypical pixels by comparing the atypical pixels to memory files on the discrete bodies stored on the at least one digital computer means; a sixth algorithm for calculating the distance of the discrete bodies from the intersection; a computational algorithm for calculating the speed of the discrete bodies and for estimating the time of arrival of the discrete bodies to the intersection; a seventh algorithm for determining a distance along each intersecting lane for the camera means to capture images; an eighth algorithm for calculating an expected new location of the discrete bodies; or combinations thereof;

c) a plurality of inputs in communication with each of the at least one central processing units for receiving data from the plurality of algorithms and a plurality of outputs in communication with each central processing unit for sending signals to the camera means;

d) based on the calculated size, location speed, distance from the intersection and direction of travel, using computer instructions on at least one central processing unit for determining the most efficient and effective protocol for allowing at least one such discrete bodies to enter and safely pass through the intersection, and e) using computer instructions on at least one central processing unit to signal a control means to operate at such a safe and efficient method for allowing one or more of the discrete bodies to pass through said intersection.

9. The process of claim 8 farther comprising a fail safe intersectional area protocol in the event that a useable image or series of images cannot be captured.

10. The process of claim 8 further comprising the step of f) intervening in the process at any step by an operator to manually control the intersectional control means.

11. The process of claim 8 further comprising in said step b) using separate computational devices for each algorithm or subroutine so that simultaneous parallel processing of all simplified digital image processing and computations is carried out allowing traffic control in real time.

12. The apparatus of claim 1, further comprising a library of defective pixels maintained on the digital computer means; wherein the defective pixels are pixels that have become non-responsive to light, for excluding the defective pixels from use by the computer instructions with algorithms.

13. The process of claim 8, further comprising in step b) maintaining a library of defective pixels on the digital computer means; wherein the defective pixels are pixels that have become non-responsive to light, for excluding the defective pixels from use by the computer instructions with the plurality of algorithms.

* * * * *